US007565934B2

(12) United States Patent
Chen et al.

(10) Patent No.: US 7,565,934 B2
(45) Date of Patent: Jul. 28, 2009

(54) HANDLE DEVICE FOR A HAMMER GUN

(75) Inventors: Chun-Hao Chen, Taichung Hsien (TW); Yueh-Pei Liu, Taichung Hsien (TW)

(73) Assignee: Shun Tai Precision Co., Ltd., Taichung Hsien (TW)

( * ) Notice: Subject to any disclaimer, the term of this patent is extended or adjusted under 35 U.S.C. 154(b) by 106 days.

(21) Appl. No.: 11/755,910

(22) Filed: May 31, 2007

(65) Prior Publication Data

US 2008/0029284 A1 Feb. 7, 2008

(30) Foreign Application Priority Data

Jun. 19, 2006 (TW) ..... 95210653 U

(51) Int. Cl.
*B25D 17/04* (2006.01)

(52) U.S. Cl. ..... 173/170; 173/162.2; 173/168; 173/169

(58) Field of Classification Search ..... 227/10, 227/130; 173/168, 169, 170, 171, 217, 93, 173/162.2, 162.1; 16/431
See application file for complete search history.

(56) References Cited

U.S. PATENT DOCUMENTS 2,864,338 A * 12/1958 Zimmermann ..... 173/169
4,732,221 A * 3/1988 Dudek ..... 173/170
4,771,833 A * 9/1988 Honsa ..... 173/162.2
5,738,177 A * 4/1998 Schell et al. ..... 173/178
5,765,652 A * 6/1998 Mathis et al. ..... 173/217
5,930,899 A * 8/1999 Hartman et al. ..... 30/168
6,192,997 B1 * 2/2001 Tsai et al. ..... 173/211
6,568,483 B2 * 5/2003 McCallops et al. ..... 173/169
6,668,941 B2 * 12/2003 Phillips et al. ..... 173/93.5
6,668,942 B1 * 12/2003 Lin ..... 173/211
6,984,188 B2 * 1/2006 Potter et al. ..... 475/298
7,383,894 B2 * 6/2008 Chen et al. ..... 173/162.1
7,401,662 B2 * 7/2008 Honsa ..... 173/211

* cited by examiner

*Primary Examiner*—Scott A. Smith
(74) *Attorney, Agent, or Firm*—Fitzpatrick, Cella, Harper & Scinto

(57) ABSTRACT

A handle device for a hammer gun includes a tubular sleeve and a handle body. The tubular sleeve is adapted to connect threadedly with a barrel of the hammer gun, and includes front and rear end faces, a peripheral wall interconnecting the front and rear end faces, an installing cavity extending from the front end face toward the rear end face and adapted to receive therein the barrel of the hammer gun, and a retaining portion provided on the peripheral wall. The handle body has a grip portion, and a casing portion molded directly over the tubular sleeve and engaging the retaining portion so that the tubular sleeve is connected immovably to the handle body.

3 Claims, 7 Drawing Sheets

HANDLE DEVICE FOR A HAMMER GUN

CROSS-REFERENCE TO RELATED APPLICATION

This application claims priority of Taiwanese Application No. 095210653, filed on Jun. 19, 2006.

BACKGROUND OF THE INVENTION

1. Field of the Invention

This invention relates to a handle device, more particularly to a handle device for a hammer gun.

2. Description of the Related Art

Referring to FIG. 1, a currently available handle device 1 for a hammer gun is made of metal, and is made into a unitary body having a connecting portion 11 to connect threadedly with a barrel 100 of the hammer gun, and a handgrip portion 12 extending downwardly from the connecting portion 11 for gripping by an operator during use of the hammer gun. The connecting portion 11 has a surrounding wall 112 defining a cavity 111 and an air inlet port 113 to permit highly compressed air to flow therethrough.

The handgrip portion 12 is formed with an air passage 121 communicated fluidly with the air inlet port 113, a mounting hole 123 extending inwardly from an outer peripheral wall 122 of the handgrip portion 12 for mounting of a switch 101 therein and communicated fluidly with the air passage 121, and an air inlet channel 125 extending inwardly from a bottom face 124 of the hand grip portion 12 and communicating fluidly with the mounting hole 123. A tube (not shown) can be connected to the air inlet channel 125 for supply of the highly compressed air.

In use, the operator holds with one hand the handgrip portion 12 and presses a back end of the connecting portion 11 with the other hand, after which the switch 101 is pressed so that highly compressed air can flow through the air inlet channel 125, the mounting hole 123, the air passage 121, the air inlet port 113, and into the cavity 111, thereby activating the hammer gun so that the hammer gun can produce a hammering action.

Although the aforementioned handle device 1 can facilitate gripping by the operator during the hammering action, in actual practice, it still has the following drawbacks:

1. Since the entire handle device 1 is made of metal, in fabricating the handle device 1, it is difficult to process the metal, e.g., to bore the metal to form the air passage 121, the mounting hole 123, and the air inlet channel 125. Therefore, the production of the device 1 is slow. Further, due to the use of metal, the material cost of the device 1 is high.

2. In use, the operator's hands, aside from having to press the back end of the connecting portion 11, also have to support the weight of the barrel 100 and of the handle device 1. Since the entire handle device 1 is made of metal and is thus heavy, when the operation time is extended, the operator's hands are easily fatigued. After a long period of use, the operator's hands may even become injured.

SUMMARY OF THE INVENTION

Therefore, the object of the present invention is to provide a handle device for a hammer gun that is capable of overcoming the aforementioned drawbacks of the prior art.

According to this invention, a handle device for a hammer gun comprises a tubular sleeve and a handle body. The tubular sleeve is adapted to connect threadedly with a barrel of the hammer gun, and includes front and rear end faces, a peripheral wall interconnecting the front and rear end faces, an installing cavity extending from the front end face toward the rear end face and adapted to receive therein the barrel of the hammer gun, and a retaining portion provided on the peripheral wall. The handle body has a grip portion, and a casing portion molded directly over the tubular sleeve and engaging the retaining portion so that the tubular sleeve is connected immovably to the handle body.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
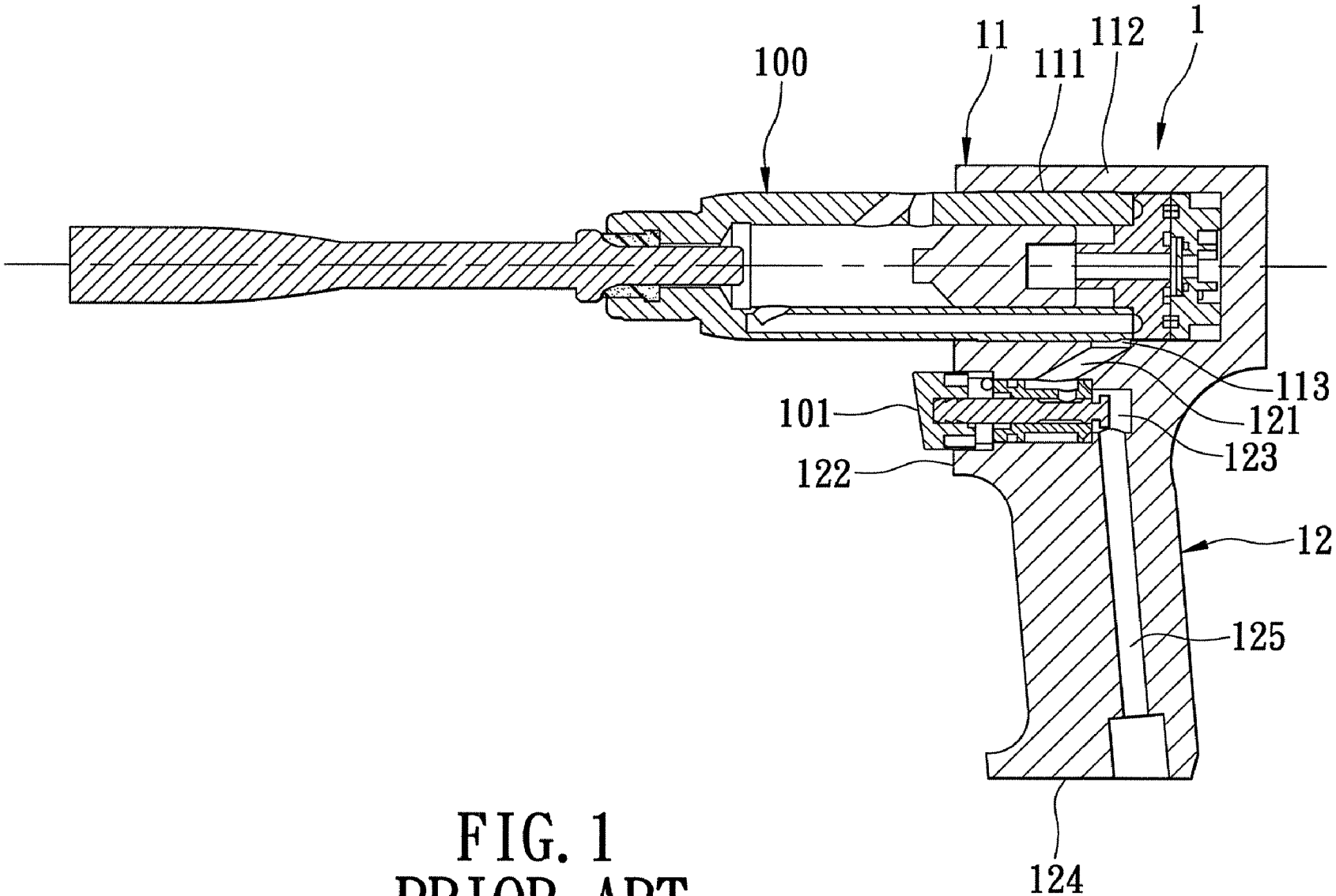
FIG. 1 PRIOR ART
FIG. 1 is a sectional view of a hammer gun incorporating a currently available handle device.
Figure 2:
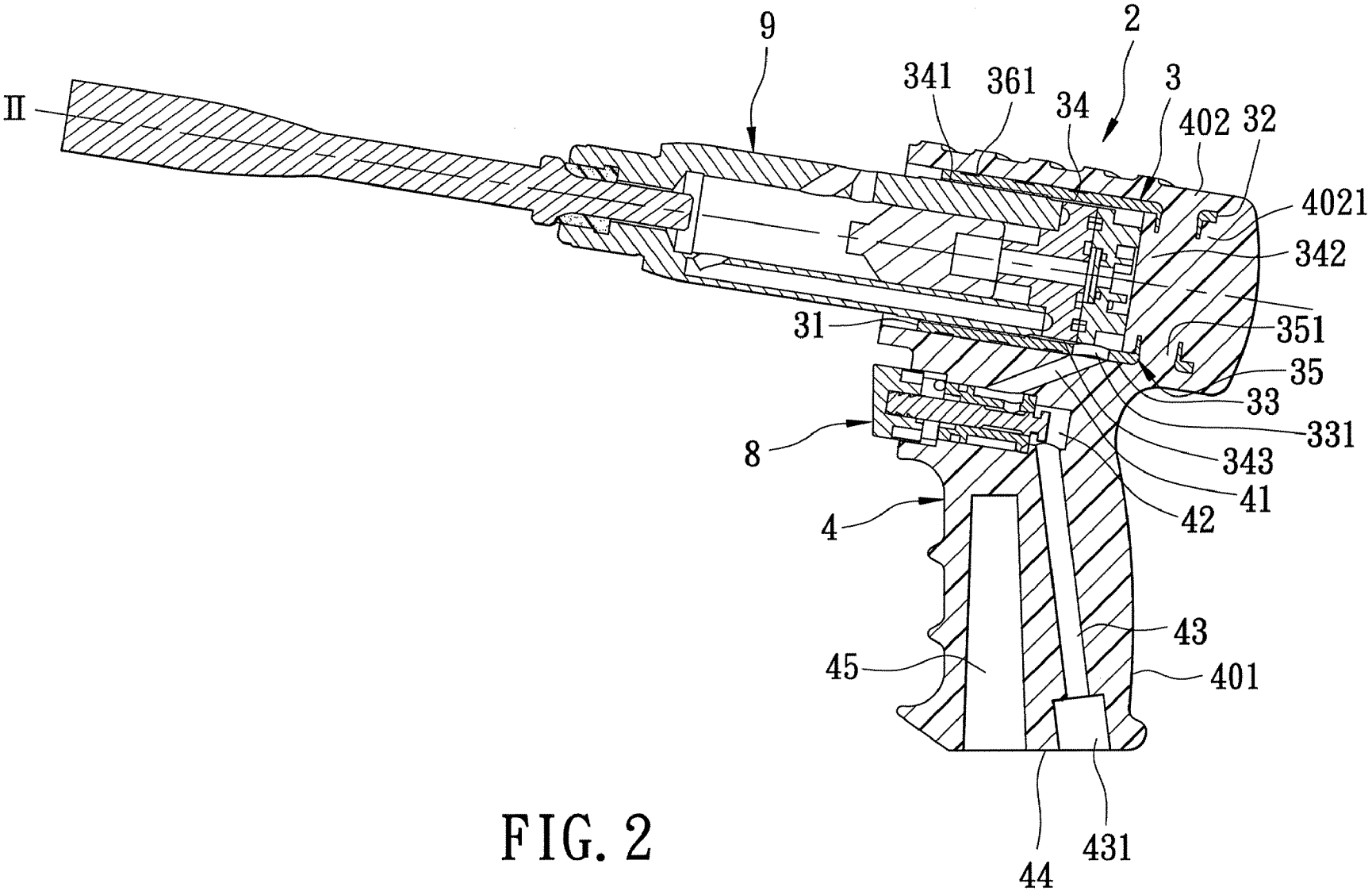
FIG. 2 is a sectional view of a hammer gun incorporating a handle device according to the preferred embodiment of the present invention.
Figure 3:
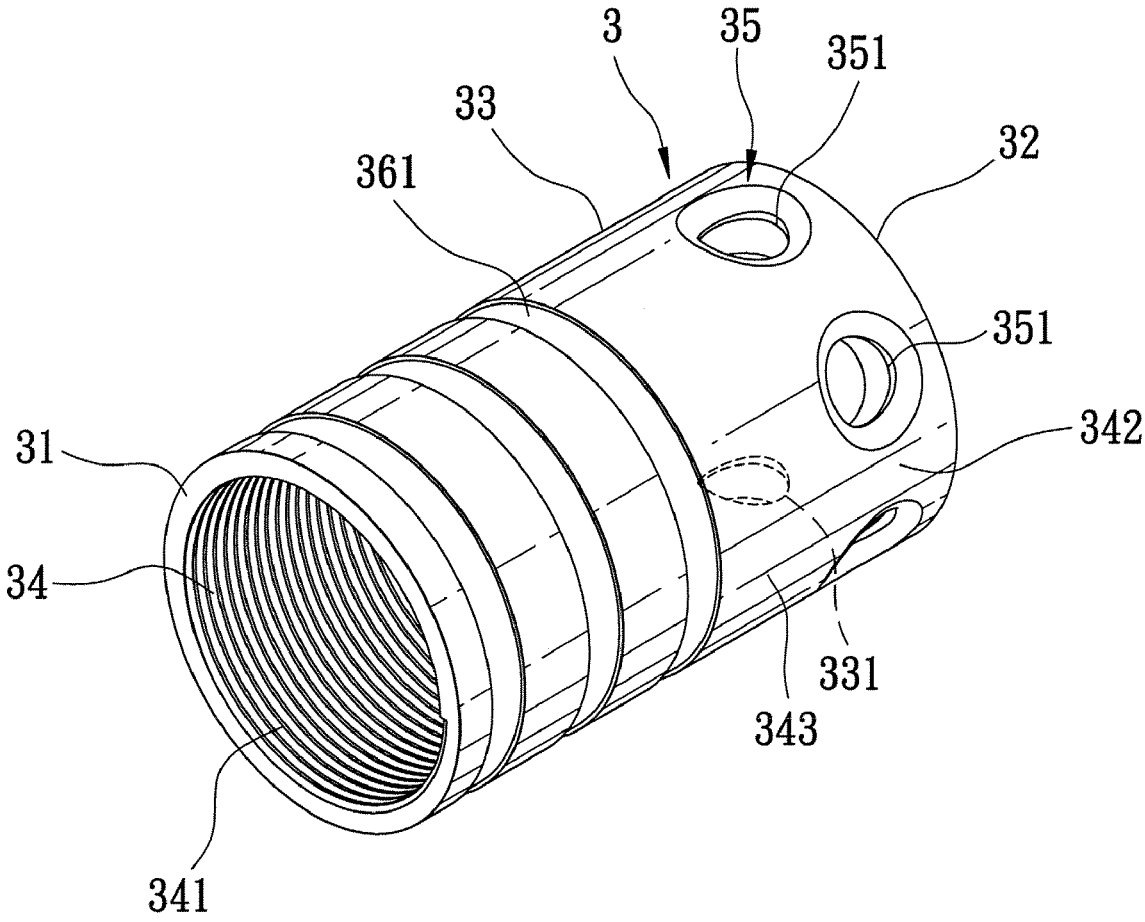
FIG. 3 is a perspective view of a tubular sleeve of the preferred embodiment.

Referring to FIGS. 2 and 3, the preferred embodiment of a handle device 2 for a hammer gun according to the present invention is adapted to connect threadedly with a barrel 9 of the hammer gun, and is shown to comprise a tubular sleeve 3 and a handle body 4.

The tubular sleeve 3 is made of metal, defines an axis (II), and includes front and rear end faces 31, 32, a peripheral wall 33 interconnecting the front and rear end faces 31, 32, an installing cavity 34 extending from the front end face 31 toward the rear end face 32 and adapted to receive therein the barrel 9, and a retaining portion 35 provided on the peripheral wall 33. The peripheral wall 33 includes an internally threaded section 341 proximate to the front end face 31 and adapted to engage threadedly the barrel 9 of the hammer gun, a fixing section 342 proximate to the rear end face 32, and an air inlet section 343 connected between the internally threaded section 341 and the fixing section 342. The fixing section 342 has the retaining portion 35, and an open end (not visible in FIG. 3) at the rear end face 32 of the tubular sleeve 3. The retaining portion 35 includes a plurality of angularly spaced-apart through holes 351 extending radially through the fixing section 342. The air inlet section 343 has an air inlet port 331 extending radially through the air inlet section 343 and communicating fluidly with the installing cavity 34.

Preferably, the peripheral wall 33 of the tubular sleeve 3 is further provided with at least one auxiliary positioning recess 361 extending annularly in an outer surface of the internally threaded section 341. In this embodiment, the peripheral wall 33 is provided with three spaced-apart auxiliary positioning recesses 361.

The handle body 4 is made of plastic, and has a grip portion 401 and a casing portion 402 molded directly over the tubular sleeve 3. The grip portion 401 has an air passage 41 communicating fluidly with the air inlet port 331 of the tubular sleeve 3, a mounting hole 42 for mounting of a switch 8 therein and communicating fluidly with the air passage 41, and an air inlet channel 43 extending from the mounting hole 42 to a bottom wall face 44 of the handle body 4. The casing portion 402 has a part 4021 filling and engaging the open end of the fixing section 342 and the through holes 351 in the retaining portion 35. The bottom wall face 44 of the handle body 4 is provided with a hole 431 that communicates fluidly with the air inlet channel 43. A tube (not shown) may be connected to the air inlet channel 43 via the hole 431 for supply of highly compressed air. By pressing the switch 8, highly compressed air can flow from the air inlet channel 43 through the mounting hole 42, the air passage 41, the air inlet port 331, and in to the installing cavity 34, so that the barrel 9 is activated to produce a hammering action.

During manufacture of the handle device 2, the tubular sleeve 3 is first positioned inside a mold cavity of a mold assembly (not shown), after which a plurality of auxiliary forming blocks (not shown), which can be removed after molding, are placed respectively at predetermined positions within the mold cavity. Molten plastic material is then injected into the mold cavity. After the plastic material is molded over the tubular sleeve 3 and is formed into the handle body 4, the auxiliary forming blocks are removed from the handle body 4. The handle device 2 formed in this manner has the tubular sleeve 3 integral with the handle body 4.

The handle body 4 has an air-discharge groove 45 (see FIG. 2) in communication with the external environment. The function of the air-discharge groove 45 is to permit discharging of air during the injection molding process. The presence of the air-discharge groove 45 does not affect the strength of the connection between the handle body 4 and the tubular sleeve 3 nor does it affect the function of the handle device 2.

In the injection molding process, the plastic material is filled into the open end of the fixing section 342 and the through holes 351 of the retaining portion 35, so that the tubular sleeve 3 is connected immovably to the handle body 4. Through the temporary placement of the auxiliary forming blocks in the internally threaded section 341 and the air inlet section 343 of the tubular sleeve 3 during the molding of the handle body 4, the internally threaded and air inlet sections 341, 343 are prevented from being filled with the plastic material. Moreover, the plastic material also fills and covers the auxiliary positioning recesses 361, so that the tubular sleeve 3 and the handle body 4 interengage further to prevent relative movement therebetween. Hence, the connection between the tubular sleeve 3 and the handle body 4 is strong and stable.

Figure 4:
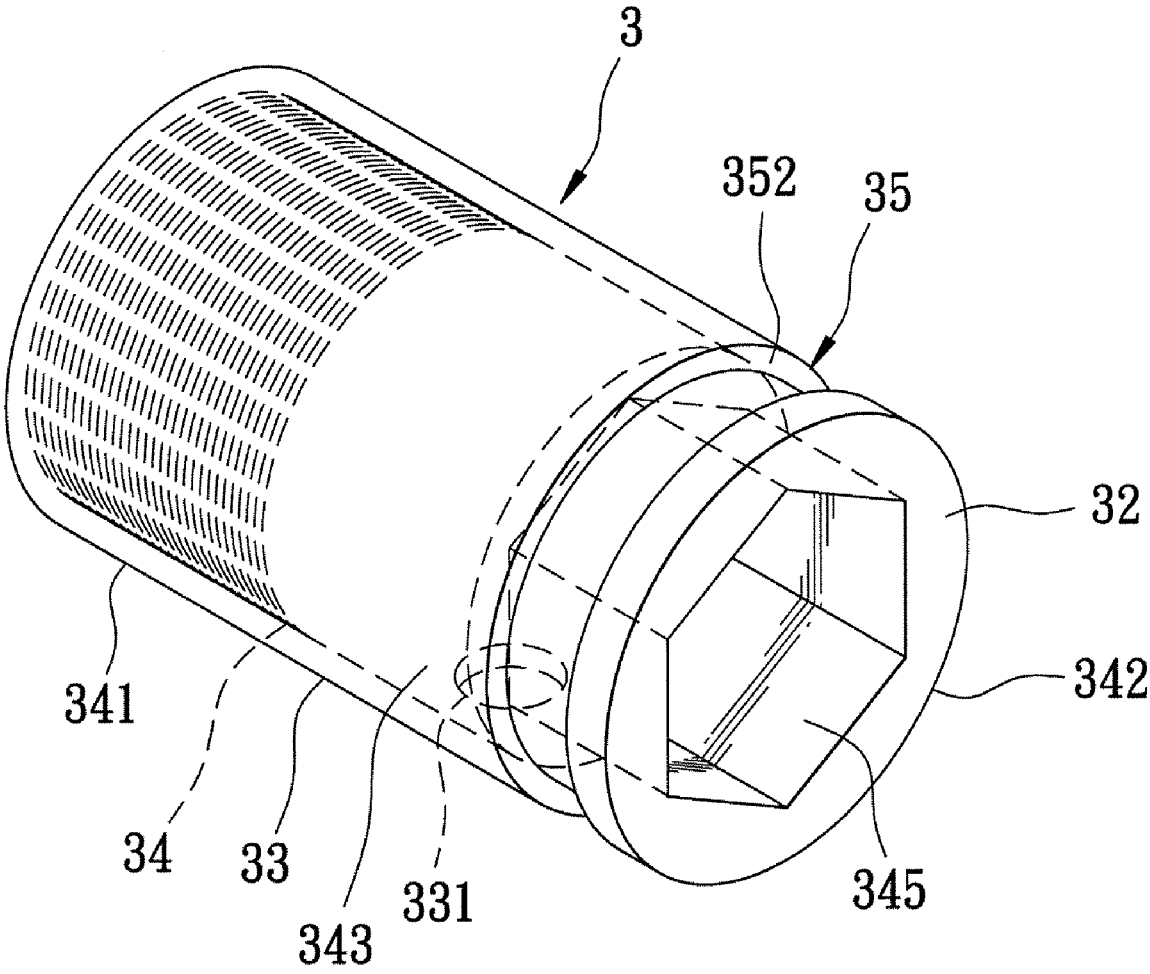
FIG. 4 is a perspective view of an alternative form of the tubular sleeve of the preferred embodiment.

In an alternative embodiment, referring to FIG. 4, the open end 345 of the fixing section 342 of the tubular sleeve 3 is of polygonal cross section, and the peripheral wall 33 is indented to form the retaining portion 35. The retaining portion 35 includes an annular groove 352 formed in an outer surface of the fixing section 342. The part 4021 of the casing portion 402 of the handle body 4 (see FIG. 2) also fills and engages the open end 345 and the annular groove 352. Because of the polygonal open end 345 of the fixing section 342 and the presence of the annular groove 352, the tubular sleeve 3 cannot rotate nor axially move relative to the handle body 4. Hence, the handle body 4 and the tubular sleeve 3 are connected stably to each other. Although the fixing section 342 is shown to have a hexagonal cross section, the shape of the fixing section 342 is not limited thereto. As long as the fixing section 342 is not circular in cross section which can permit rotation, the fixing section 342 may have a cross section of any geometrical or irregular shape, such as a tetragonal, pentagonal, octagonal, heart-shaped or star-shaped cross section, which can restrict rotation of the tubular sleeve 3 relative to the handle body 4.

Figure 5:
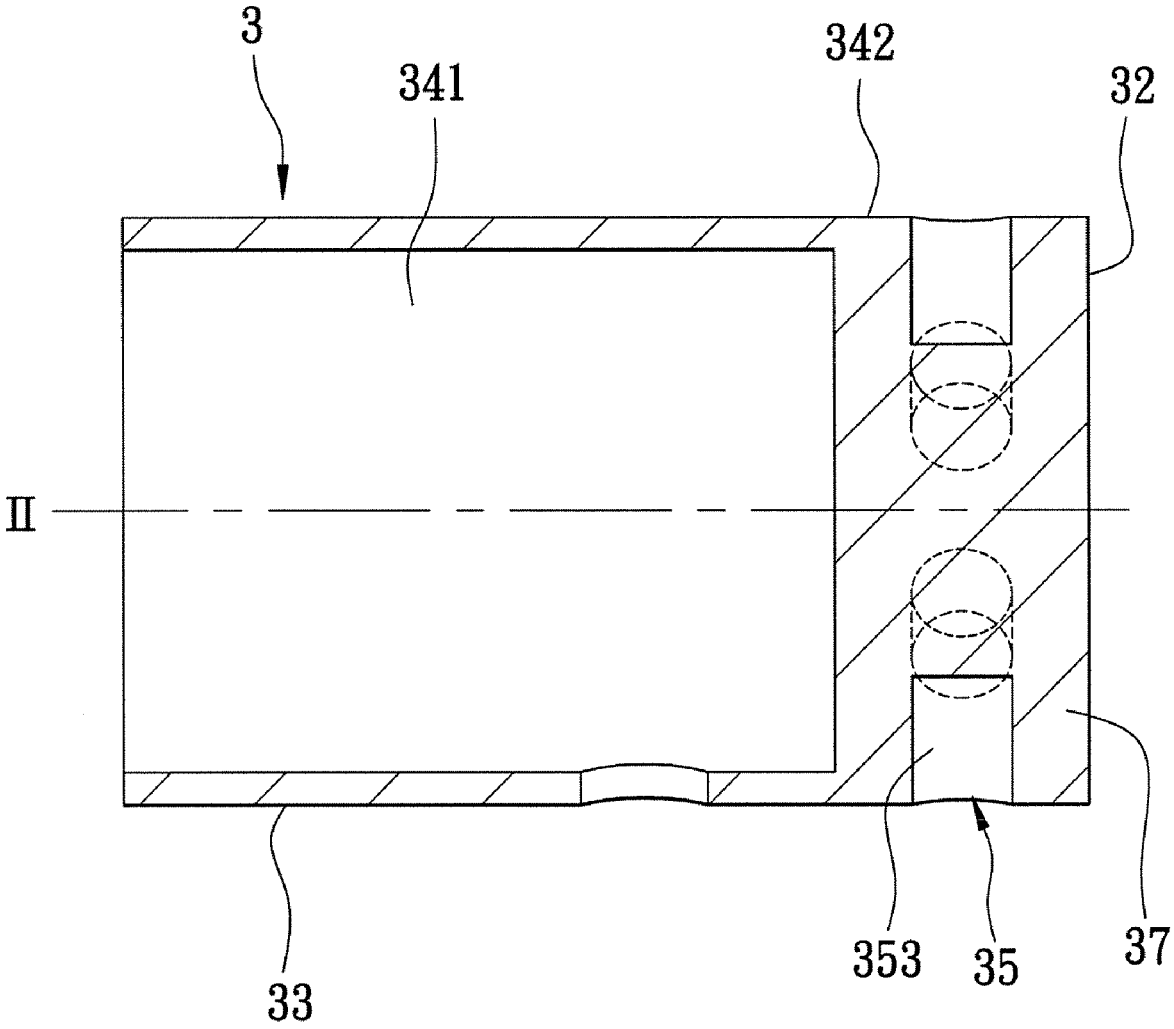
FIG. 5 is a sectional view of another alternative form of the tubular sleeve of the preferred embodiment.
Figure 6:
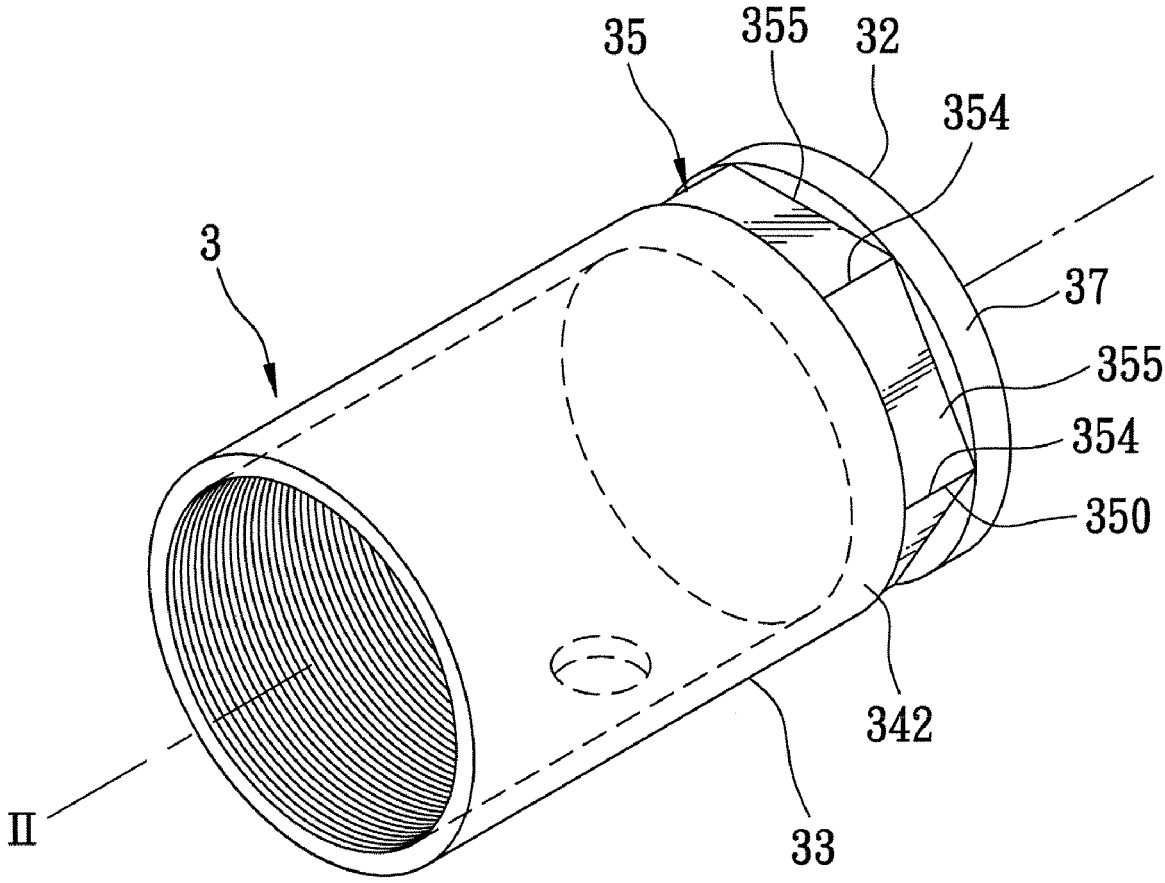
FIG. 6 is a perspective view of still another alternative form of the tubular sleeve of the preferred embodiment.

In another alternative embodiment, referring to FIG. 5, the fixing section 342 of the peripheral wall 33 of the tubular sleeve 3 has a closed end wall 37 forming the rear end face 32, and the retaining portion 35 of the tubular sleeve 3 includes a plurality of angularly spaced-apart blind bores 353 extending radially in the closed end wall 37. The retaining portion 35 may also be as shown in FIG. 6, i.e., the retaining portion 35 may include a polygonal section 350 that surrounds the outer surface of the fixing section 342 and that has a plurality of corners 354 and flat sides 355 between adjacent ones of the corners 354. The part 4021 of the casing portion 402 of the handle body 4 (see FIG. 2) also fills and engages the blind bores 353 or the polygonal section 350, so that the stable connection between the tubular sleeve 3 and the handle body 4 can be similarly attained.

Figure 7:
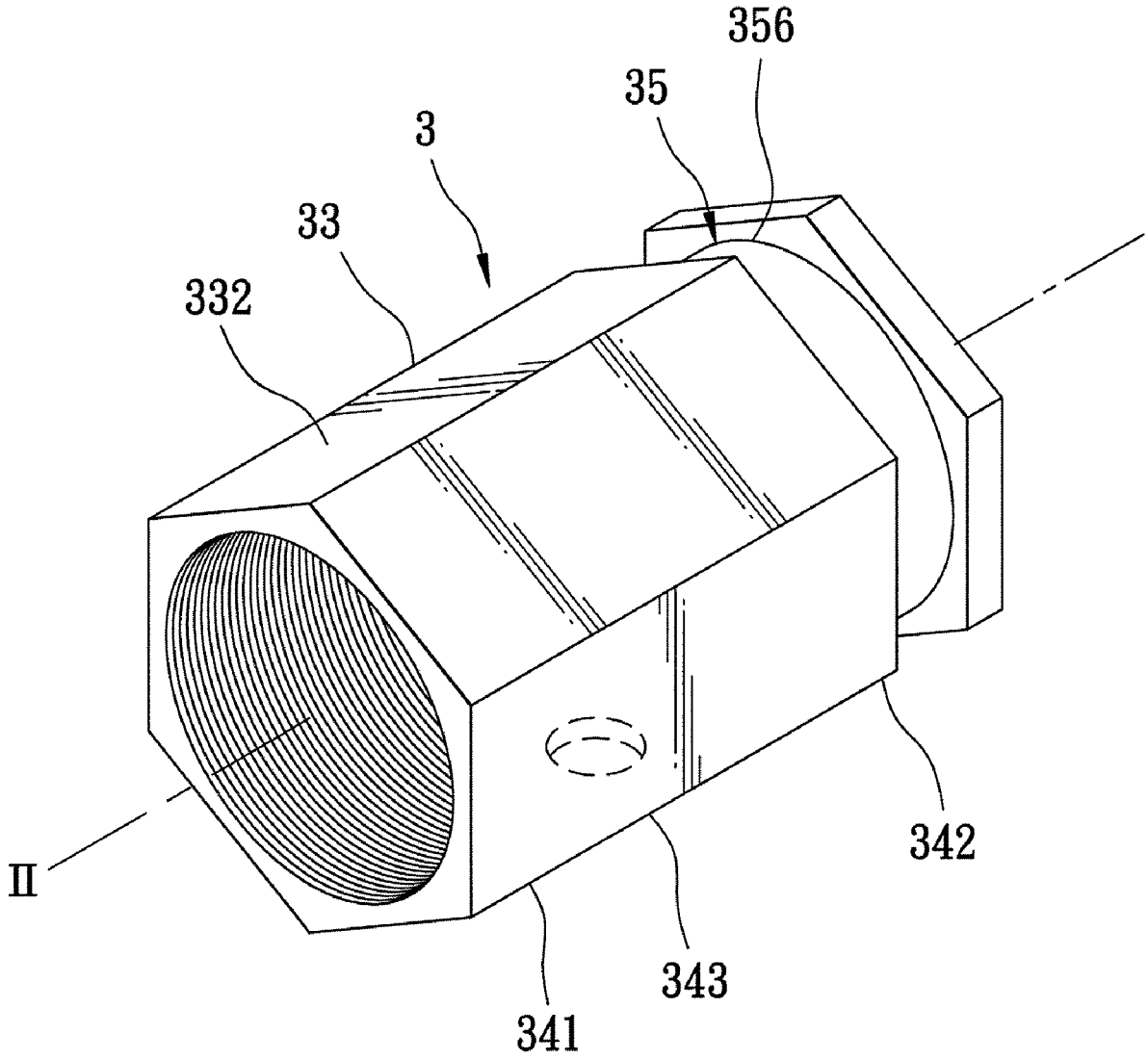
FIG. 7 is a perspective view of yet another alternative form of the tubular sleeve of the preferred embodiment.

In still another alternative embodiment, referring to FIG. 7, the peripheral wall 33 of the tubular sleeve 3 is directly formed with a polygonal outer surface 332 in the internally threaded section 341, the air inlet section 343, and the fixing section 342, and the retaining portion 35 has an annular groove 356 extending in the polygonal outer surface 332. The retaining portion 35 may have a plurality of angularly spaced-apart retaining holes (not shown) extending radially in the outer polygonal surface 332 instead of the annular groove 356. Similarly, the handle body 4 and the tubular sleeve 3 are prevented from moving axially relative to each other through the retaining portion 35, and are prevented from rotating relative to each other through the polygonal outer surface 332 of the peripheral wall 33.

Hence, by varying the configurations of the retaining portion 35 and the peripheral wall 33 of the tubular sleeve 3, the tubular sleeve 3 and the handle body 4 respectively made of metal and plastic can be immovably and stably connected to each other to form the handle device 2 of the present invention.

From the aforementioned description of the present invention, the advantages of the handle device 2 of the present invention can be summarized as follows:

1. Since the handle body 4 is made by injection molding using a plastic material, and through the use of the auxiliary forming blocks and the mold assembly, the handle body 4 can be formed into a predetermined shape without the need to undergo additional processing steps, so that the process time and the labor time needed in the making of the handle device 2 are minimized. Further, since the handle body 4 is made of plastic, the material cost of the handle device 2 is also minimized.

2. Although the tubular sleeve 3 is made of metal so as to resist the striking force of the hammering action, the handle body 4 which occupies a larger part of the handle device 2 is made of plastic, so that the weight of the entire handle device 2 is reduced. Hence, fatigue of the operator's hands following a long period of use can be minimized, and injuries to the operator's hands can be reduced as well.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A handle device for a hammer gun, comprising:

a tubular sleeve made of metal, adapted to connect threadedly with a barrel of the hammer gun, and including front and rear ends, a peripheral wall interconnecting said front and rear ends, an installing cavity extending from said front end toward said rear end and adapted to receive therein the barrel of the hammer gun, and a retaining portion provided on said peripheral wall, said peripheral wall including an internally threaded section proximate to said front end and adapted to engage threadedly the barrel of the hammer gun, and a fixing section proximate to said rear end and having said retaining portion, said retaining portion including a plurality of angularly spaced-apart through holes extending radially through said fixing section; and a handle body made of plastic and having a grip portion, and a casing portion molded directly over said tubular sleeve;

wherein said rear end is an open end, said casing portion of said handle body having a part filling and engaging said open end and said through holes so that said tubular sleeve is connected immovably to said handle body, said grip portion being free of metal.

2. The handle device of claim 1, wherein said peripheral wall further includes an air inlet section connected between said internally threaded and fixing sections and having an air inlet port extending radially through said air inlet section.

3. The handle device of claim 1, wherein said peripheral wall further includes at least one auxiliary positioning recess extending annularly in an outer surface of said internally threaded section.

* * * * *